US005103847A

United States Patent [19]

Martin et al.

[11] Patent Number: 5,103,847

[45] Date of Patent: Apr. 14, 1992

[54] DEVICE FOR SUPPORTING TUBE BUNDLES FOR CLEANING

[75] Inventors: Richard J. Martin, Winter Springs; Robert C. Hurman, Tampa; Michael G. Verbonitz, Geneva; Paul Toy, Jr., Oviedo, all of Fla.; William A. Weiland, Chance, Md.

[73] Assignee: Westinghouse Electric Corp., Pittsburgh, Pa.

[21] Appl. No.: 612,039

[22] Filed: Nov. 13, 1990

[51] Int. Cl.[5] ..... B08B 3/04

[52] U.S. Cl. ..... 134/157; 134/166 R; 134/140; 134/201

[58] Field of Search ..... 134/166 R, 157, 186, 134/134, 84, 104.4, 137, 140, 201

[56] References Cited

U.S. PATENT DOCUMENTS

| | | | |
|---|---|---|---|
| 4,071,376 | 1/1978 | McNeer | 134/186 |
| 4,077,416 | 3/1978 | Johnson, Jr. et al. | 134/92 X |
| 4,175,849 | 11/1979 | Wilkinson | 134/157 X |
| 4,621,652 | 11/1986 | Ozawa | 134/104.4 X |
| 4,772,374 | 9/1988 | Urquhart et al. | 134/157 |

*Primary Examiner*—Frankie L. Stinson

[57] ABSTRACT

A movable holding fixture receives an elongated oil cooler tube bundle, supports the tube bundle along its length and prevents bending of the tubes when the holding fixture/tube bundle combination is lowered from a vertical to a horizontal position into a vat for chemical cleaning. V-supports are provided in the vat to receive the tube bundle. A device to rotate the tube bundle in the vat is provided to facilitate the cleaning of the tube bundle.

9 Claims, 5 Drawing Sheets

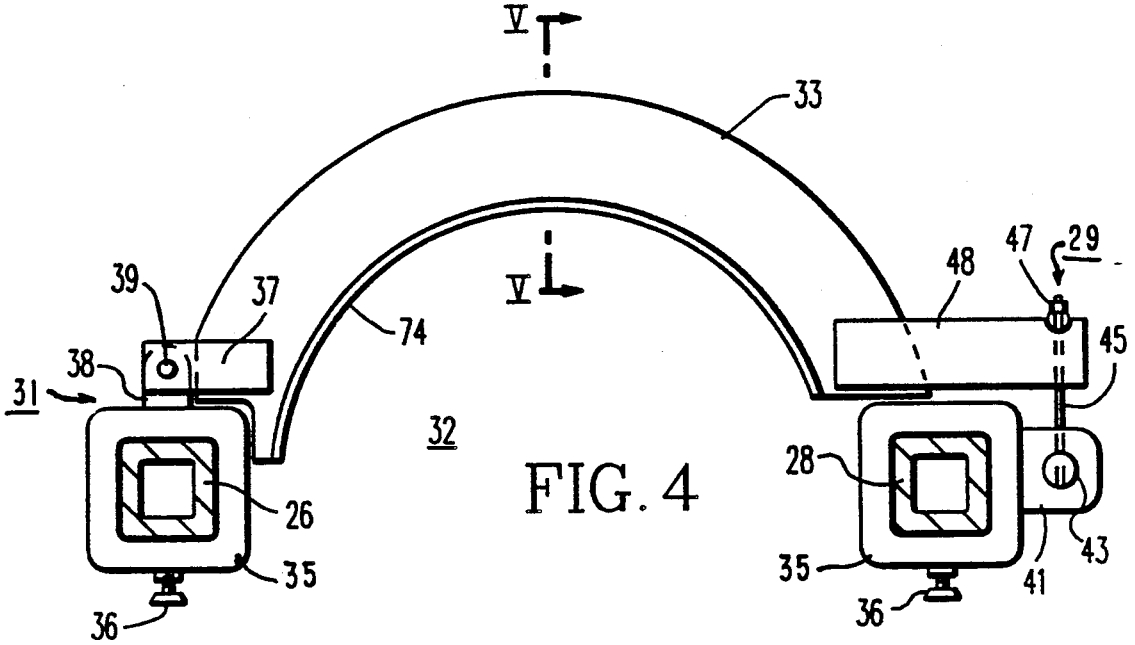
FIG. 4
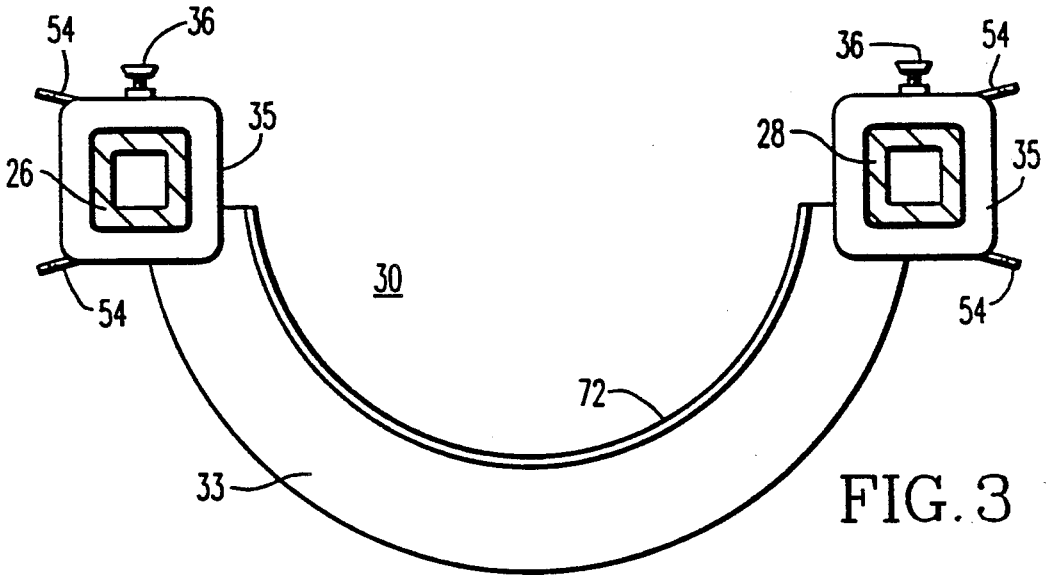
FIG. 3
FIG. 5
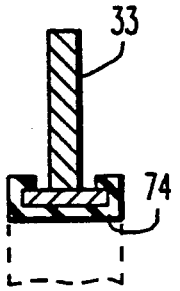

DEVICE FOR SUPPORTING TUBE BUNDLES FOR CLEANING

BACKGROUND OF THE INVENTION

This invention relates to periodic cleaning of heat exchangers and, more particularly, to a structure for supporting, transporting and subsequent cleaning of a tube bundle after removal of the bundle from an oil cooler shell.

Turbine generators include parts such as bearings which must be lubricated and cooled during operation of the generator. Oil has been used as the lubricating and cooling medium. As the oil moves across the bearings, the oil heats up and must itself be cooled. For this purpose, the oil is recirculated through a cooler shell which houses a bundle of over a thousand elongated tubes through which cooling water is passed. The oil repeatedly passes across the tubes, cools, and returns to the turbine generator.

The tube bundles must be periodically removed from the cooler shells and cleaned to ensure proper operation of the bundles and oil system cleanliness. Conventionally, a tube bundle removed from a cooler shell might remain vertical and be cleaned within a curtain structure adjacent the cooler shell. However, this method does not allow full cleaning of the tube bundle and erecting the temporary curtain structure is time consuming.

Alternatively, the vertical bundle is removed via an overhead crane and placed horizontally in a chemical cleaning vat. Use of the vat eliminates the need to erect the curtain structure. However, the tube bundles are not inherently strong structures. They are not made to be simply flipped from the vertical to the horizontal. For example, after the tube bundles are manufactured horizontally, they are inserted in the cooler shell and the shell is flipped to the vertical. Thus, the tube bundle would bend or bow if moved from the vertical to the horizontal position. Of course, overall heat exchanger operational costs and power plant down-time increases, while the bent bundles are being repaired/replaced.

Finally, due to the relative bulkiness of the bundle, it is difficult to clean the tube bundle in the conventional vat.

SUMMARY OF THE INVENTION

Accordingly, it is a purpose of the present invention to provide a structure for supporting the tube bundles after they are removed from the vertical, operational position in the oil cooler shell.

It is another purpose of the present invention to provide a supporting device for a tube bundle, which device allows the safe pivoting of the tube bundle from the vertical to a horizontal position in a chemical cleaning vat.

It is another purpose of the present invention to provide a structure for supporting the tube bundle in the vat for facilitated cleaning.

It is another purpose of the present invention to provide a single support for both facilitating safe movement of the bundle to and from the cleaning vat and for facilitating cleaning.

Finally, it is a purpose of the present invention to provide a device for rotating the tube bundle in the vat to facilitate cleaning.

To achieve the foregoing and other purposes of the present invention there is provided a separate, movable holding fixture that supports the periphery of the elongated tube bundle and prevents the tube bundle from being damaged, while being lowered from the vertical to the horizontal into the cleaning vat. The holding fixture is a superstructure consisting of a top rectangular rail, a bottom rectangular rail, two main, elongated, parallel, rectangular beams, a first plurality of ring clamps adjustably mounted for up and down movement on the main beams, and a second, opposite plurality of staggered ring clamps which are also adjustably mounted for up and down movement on the main beams. The positions of the clamps correspond to the positions of baffle plates of the tube bundle. One end of each of the plurality of second ring clamps is pivotably connected to one main beam and the other end is releasably latched to the other main beam. After removing the tube bundle form the oil cooler shell, the tube bundle is loaded into the holding fixture with the second plurality of clamps in the pivoted open position. A pedestal is used as a temporary support for the holding fixture and tube bundle while the tube bundle is being loaded. The second plurality of clamps is then pivoted closed and the holding fixture containing the tube bundle is removed by a crane from the pedestal, and moved to the vat, wherein one end of the holding fixture is pivotally connected to a V-support on the vat. The vat is equipped with a second V-support to support the other end of the holding fixture. This structure allows the holding fixture to be safely lowered from a vertical to a horizontal position, with the elongated tube bundle being reliably supported along its length, and into the vat for chemical cleaning, without risking any damage to the tube bundle. The holding fixture may be rotated in the vat by a turning mechanism. The turning mechanism facilitates cleaning of the tube bundle by allowing an operator to rotate the bulky holding fixture inside the vat.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 3 is a top, cross sectional view of one of the second plurality of ring clamps, taken along line III—III of FIG. 2.

FIG. 4 is a top, cross sectional view of one of the first plurality of ring clamps, taken along line IV—IV of FIG. 2.

FIG. 5 is a side, cross sectional view of the telescoping ring clamp 30, taken along line V—V of FIGS. 3 and 4.

DETAILED DESCRIPTION OF THE PREFERRED EMBODIMENTS

Figure 1:
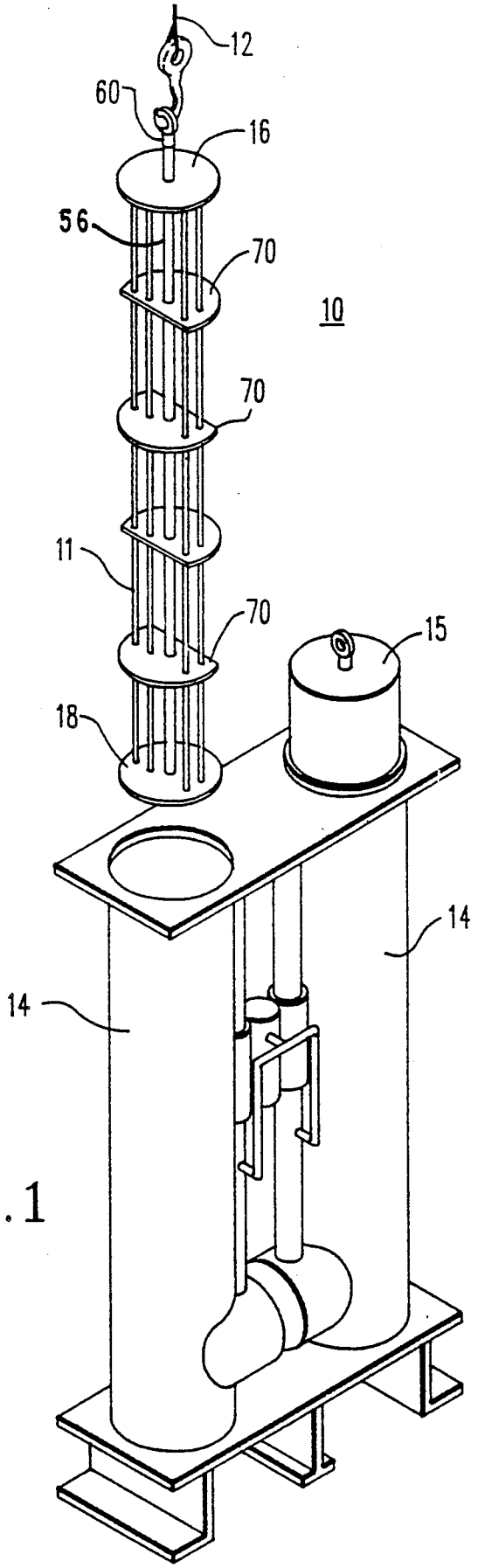
FIG. 1 is a perspective view of a tube bundle being removed from an oil cooler shell.
Figure 2:
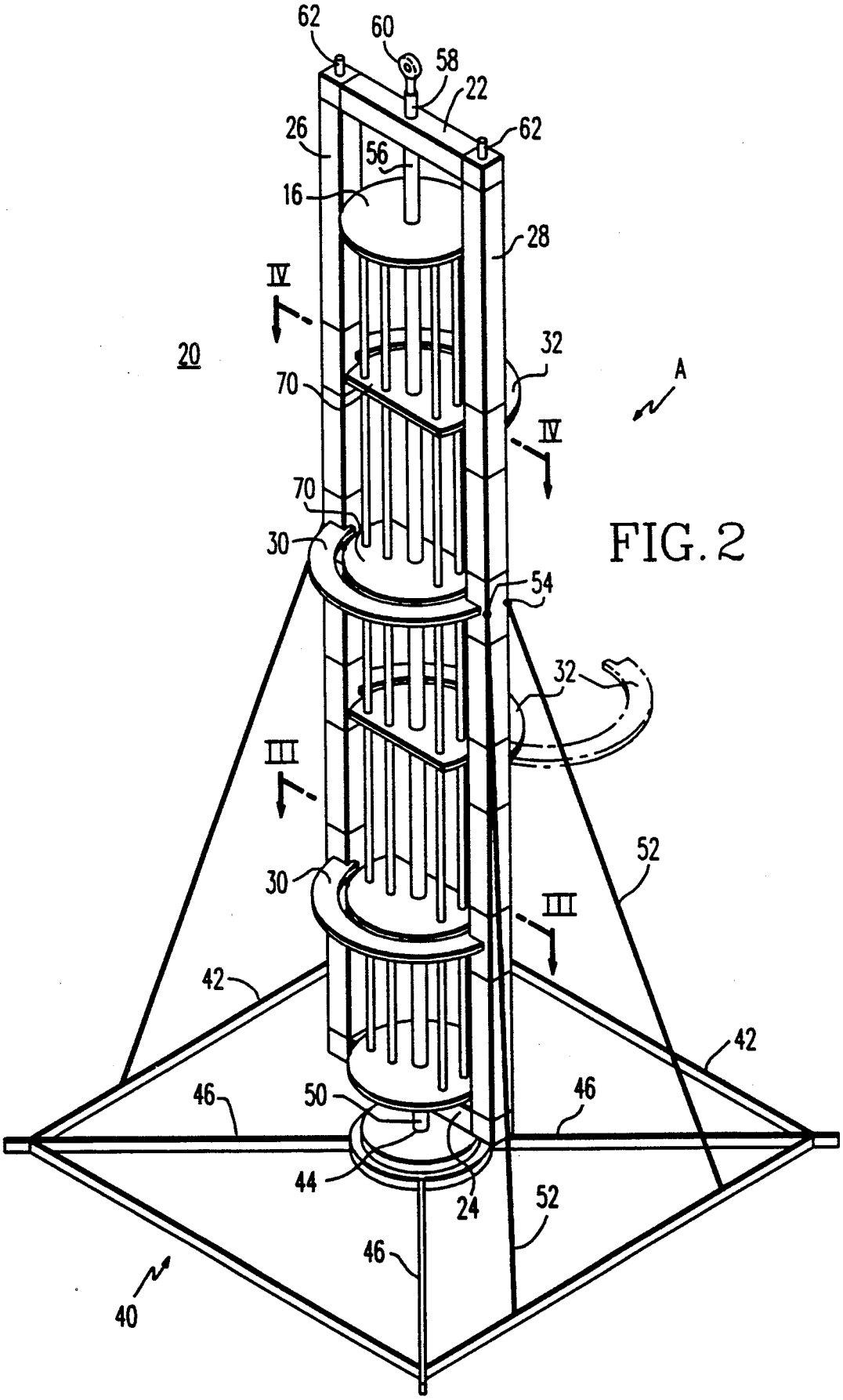
FIG. 2 is a perspective view of a holding fixture according to the present invention positioned on a pedestal and supporting the tube bundle.

FIG. 1 illustrates a tube bundle 10 being removed, via a crane 12, from an oil cooler shell 14, after the inlet chamber cover 15 has been removed. A hook of the crane 12 lifts the tube bundle 10 via an eye hook 60 connected to a staystud 56 (FIG. 2). For clarity, only the inlet tube plate 16, reverse tube plate 18, baffle plates 70, and steel support rod 11 of the tube bundle 10 are shown; the numerous tubes have not been shown.

The tube bundle 10 is usually removed from the oil cooler shell 14 for the purpose of chemical cleaning in a vat. As discussed above, however, traditionally this removal has resulted in damage to the tubes. The present invention avoids this damage and otherwise greatly facilitates cleaning of the tube bundle 10.

As shown in FIG. 2, the present invention includes a holding fixture generally indicated by reference numeral 20. The holding fixture 20 includes a top horizontal rail member 22, a bottom horizontal rail member 24, two elongated, parallel, vertical main beam members 26, 28, a first plurality of ring clamps 30, and a second plurality of ring clamps 32.

Preferably, the material for these components is carbon steel, since carbon steel is the most cost-effective and is compatible with the chemical bath: the tube bundle 10 is made of mostly copper and some steel components.

The first plurality of ring clamps 30 is positioned on one side of the holding fixture 20 and the second plurality of ring clamps 32 is positioned on the other side, in staggering fashion. The number of ring clamps 30, 32 is generally proportional to the total number of baffle plates 70. For example, a relatively short tube bundle 10 having only four or five baffle plates 70 could be accommodated in a holding fixture 20 using two ring clamps 30 and two ring clamps 32.

As shown in FIGS. 3 and 4, each of the ring clamps 30, 32 includes a half-ring 33 connected to respective end brackets 35 which slidingly receive the main beams 26, 28, but can be held stationary relative to the main beams 26, 28 via, e.g., jam bolts 36. In this manner, the first and second plurality of ring clamps 30, 32 are capable of telescoping connection relative to the holding fixture 20.

As best shown in FIGS. 3–5, each of the half rings 33 of the clamps 30, 32 has a T-shaped cross section. Each clamp 30, 32 also includes a rubber extrusion 72 and 74, respectively, along the inner diameters of the half rings 33. These extrusions 72, 74 are used to abut and resiliently support the baffle plates 70 without damage. The extrusions 72, 74 could be of several sizes, one of which is shown in phantom in FIG. 5, to act as a spacer to accommodate different sized baffle plates 70.

Specific to the first plurality of ring clamps 30, one of them located substantially centrally on the holding fixture 20, includes a pair of support tabs 54 on each end bracket 35 for the purpose of receiving guy wires 52 as described below.

Specific to the second plurality of ring clamps 32 shown in FIG. 4, between the end bracket 35 on the main beam 26 and one end of the half ring 33, there is located a pivoting means 31. The pivoting means 31 includes a hinge extension 37 formed on the end of the half ring 33, a hinge tab 38 formed on the end bracket 35, and a pin/spring clip combination 39 extending through corresponding openings formed in the hinge extension 37 and hinge tab 38. Via this pivoting means 31, each of the second plurality of ring clamps 32 is able to pivot in a plane perpendicular to the longitudinal axis of the holding fixture 20.

Each ring clamp 32 also includes releasable latch means 29. That is, the end bracket 35 at the other end of the half ring 33 includes a clamp tab 41 having an opening formed therein for receiving a pin 43 or top pivot which extends through one end of a clamp bolt 45 to allow the clamp bolt 45 to pivot. The clamp bolt 45 terminates at an opposite free end in a pin 47 or top pivot. The half ring 33 includes a ring clamp extension 48 which receives the clamp bolt pin 45.

As shown in FIG. 2, the holding fixture 20 is supported by resting it on a square pedestal 40. The pedestal 40 includes four linear sides 42, a central receptacle 44, and four cross members 46.

The pedestal 40 is only meant to be used as a temporary storage facility for the holding fixture 20 while the tube bundle 10 is being loaded therein.

A solid journal 50, integral to the bottom rail 24, rests in the central receptacle 44 of the pedestal 50. The guy wires 52 run from the support tabs 54 on a substantially central ring clamp 30 to opposing sides 42 of the pedestal 40.

While the tube bundle 10 and holding fixture 20 are in the vertical position on the pedestal 40, as shown in FIG. 2, the tube bundle 10 weight is supported by the eye hook 60, rather than resting on the reverse tube plate 18 of the tube bundle 10. The bottom of the tube bundle 10 could be damaged if it were entirely supporting the weight of the tube bundle 10.

The holding fixture 20 containing the tube bundle 10 may be moved from a vertical to a horizontal position, and into a vat 80 for chemical cleaning by the crane 12 using lifting tabs 62, which are attached to the side rails 26 and 28 and extend through the top rail 22. This movement is described in detail below.

Figure 6:
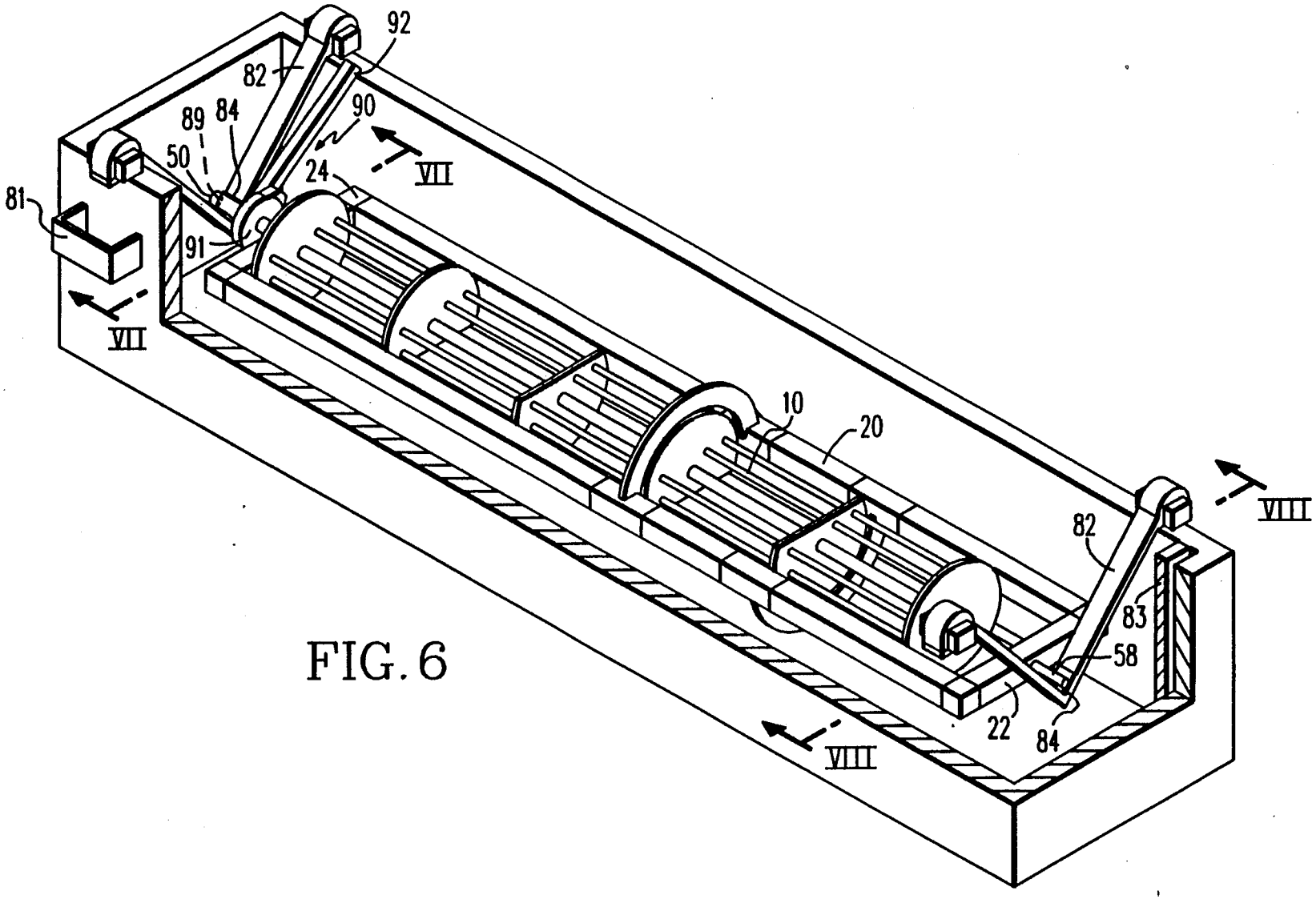
FIG. 6 is a perspective, cross sectional view of the holding fixture and tube bundle positioned in a chemical cleaning vat.
Figure 7:
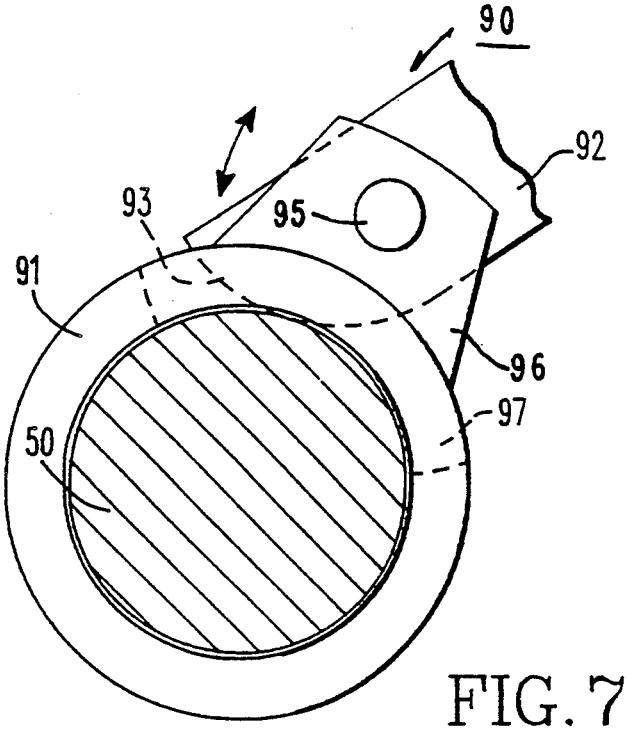
FIG. 7 is a side, cross sectional view of a turning mechanism according to the present invention, taken along line VII—VII of FIG. 6.
Figure 8:
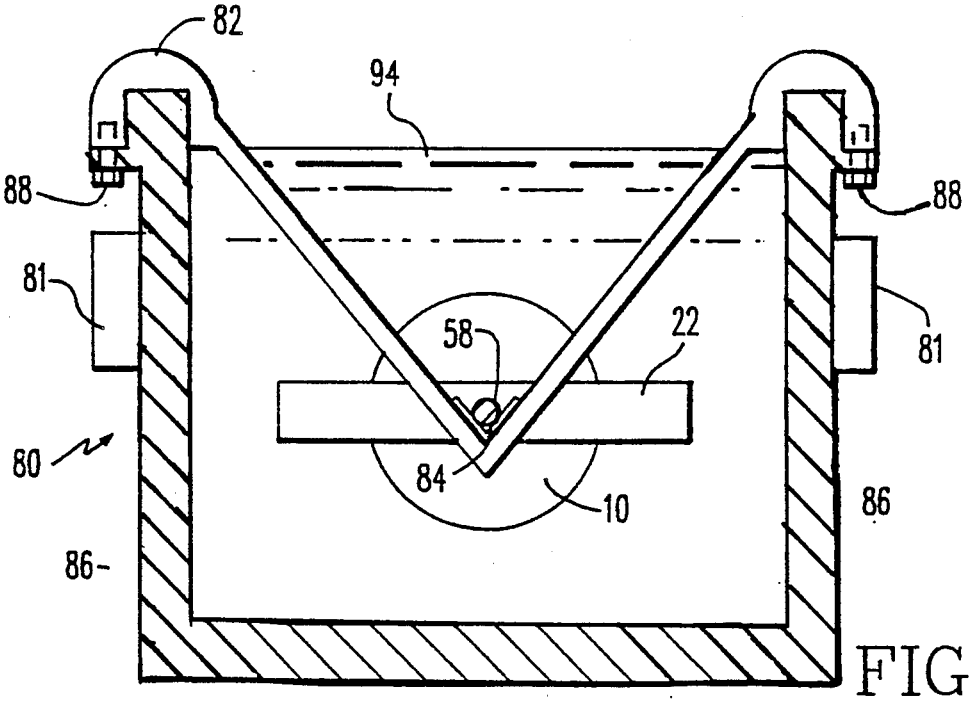
FIG. 8 is a side, cross sectional view of the vat showing a V-shaped arm for supporting the holding fixture, taken along line VIII—VIII of FIG. 6.

As shown in FIGS. 6 and 8, the vat 80 is generally an elongated box about 36' long, 4' wide and 4' high. The vat 80 includes lifting tabs 81 to allow movement of the vat 80 via the crane 12. The vat 80 may contain means (not shown) for agitating or aerating the chemical bath, if desired. Further, the vat 80 could include a transverse, movable baffle 83 for when smaller holding fixtures 20 are used, so that less chemical solution is needed.

The vat 80 is also equipped with V-supports 82 to support the holding fixture 20 by the solid journal 50 and the hollow journal 58 in minimum-friction Teflon bearings 84. The V-supports 82 are clamped on the vat walls 86 using, e.g., bolts and plates 88, and may be adjusted to allow for different-sized holding fixtures 20.

The V-supports 82 suspend the tube bundle 10 in the vat 80 so that the tube bundle 10 does not rest on the vat 80 bottom. Further, the clearance between the tube bundle 10 and the vat allows positioning of aeration means (not shown) and allows the tube bundle 10 to be rotated without interference from the vat 80. This clearance also allows the acceptance by the vat of tube bundles 10 having different diameters, without the need to modify the vat 80.

The tube bundle 10 may be rotated in the vat 80 by a turning means 90 attached to the solid journal 50. More particularly, a steel ring 91 of the turning means 90 is placed over the solid journal 50. The turning means 90 works on friction between the end 92 of a rotating arm 92 and the outer diameter of the solid journal 50 as the arm 92 pivots via a pin 95 and bracket 96 combination, and the end 93 moves in a cut out portion 97 formed in the steel ring 91. The turning means 90 allows 45° rotation via the rotating arm 92 extending beyond the side wall 86 of the vat 80. Alternatively, a toothed ratchet device could be used to turn the tube bundle 10.

The method for removing the tube bundle 10 from the cooling shell 14, placing the tube bundle 10 in the holding fixture 20 and lowering the tube bundle 10/holding fixture 20 combination into the vat 80 will now be explained.

The holding fixture 20, pedestal 40 and vat 80 are delivered to the site. The pedestal 40 is assembled on the floor. The vat 80 is positioned along one of the axes of the crane 12 for the tipping operation. The clamps 30, 32 are adjusted to the proper position while the holding fixture 20 is in its horizontal storage position in the vat 80.

The holding fixture 20 is removed from the vat 80 via the crane 12 connected to the lifting tabs 62 and placed vertically on the pedestal 40. While supporting the holding fixture 20, the guy wires 52 that hold the holding fixture 20 to the pedestal 40 are attached. The holding fixture 20 is leveled and the guy wires 52 are tensioned evenly.

The inlet chamber cover 15 is removed from the cooler shell 14. With the eye hook 60 removed from the tube bundle 10, the top rail 22 is installed over the stay-stud 56, and the eye hook 60 is re-installed through a hollow journal 58. The tube bundle 10 is then removed from the cooler shell 14 via the crane 12 and placed in the holding fixture 20.

To accommodate limited ceiling height, it is not necessary to lift the tube bundle 10 above the holding fixture's 20 full height. The tube bundle 10 can be inserted, while still vertical, in a direction perpendicular to the longitudinal axis of the holding fixture 20, as shown by arrow "A" in FIG. 2. That is, the pivoting and telescoping ring clamps 32 remain open (as one is shown in FIG. 2 in phantom), when the tube bundle 10 is slid into the holding fixture 20 between the main beams 26, 28 and are closed and latched once the tube bundle 10 is securely placed in the holding fixture 20.

The ring clamps 30, 32 may then be slid up and down on the two main beams 26, 28 of the holding fixture 20 to correspond to and support the baffle plates 70 of the tube bundle 10. The height and number of the baffle plates 70 may vary among different tube bundles 10.

The weight of the tube bundle 10 is borne by the holding fixture 20, but slight tension is maintained on the tube bundle 10 until the holding fixture 20 is secured to the tube bundle 10 and the holding fixture 20 is supported by the crane 12. The pedestal 40 is designed to support the holding fixture 20 only, not the weight of both the holding fixture 20 and tube bundle 10. The crane 12 should always be connected to the tube bundle eye hook 60 when loading and thereafter to the holding fixture 20 lifting tabs 62 when the holding fixture 20 is secured to the tube bundle 10. The clamps 30, 32 should be checked to make sure they are positioned for even weight distribution.

When the tube bundle 10 is properly seated in the holding fixture 20, the crane 12 is lightly loaded and the guy wires 52 are disconnected. Making sure that no load is on the eye hook 60, the holding fixture 20 is lifted into the vat 80 using the lifting tabs 62.

The tube bundle 10 and vat 80 may include means for facilitating this step. For example, the solid journal 50 could include a transverse cylindrical hole for temporarily receiving a corresponding pivot pin 89 extending through a bracket (not shown) formed on one of the V-supports 82. In this way, the bottom pivot is pinned into the vat 80 and the cooler is lowered to the horizontal position.

After the chemical bath 94 loosens sludge and debris, the turning means 90 facilitates cleaning the tube bundle 10 during hydroblasting using a high pressure pump connected to a hose and spray nozzle (not shown) to knock dirt and debris free.

As will readily by understood, removal of the holding fixture 20 and reinstallation of the tube bundle 10 in the cooler shell 14 is accomplished by merely reversing the above steps.

It can also be seen that if repair is needed for the tube bundle 10, said repair can be more easily done while the tube bundle 10 is in the holding fixture 20 on the pedestal 40 or in the vat 80, as opposed to in the cooler shell 14 or merely suspended via the crane 12.

The foregoing is considered illustrative only of the principles of the invention. Further, since numerous modifications and changes will readily occur to those skilled in the art, it is not desired to limit the invention to the exact construction and operation shown and described. For example, although the above description emphasizes turbine generator oil cooler tube bundles, the present invention can apply to other heat exchangers such as hydrogen coolers, or other end uses, e.g., chemical processing or oil refining. With hydrogen coolers, the baffles are of a different shape, so the clamps 30, 32 would be modified to accommodate the different shape. Basically, the invention applies to any elongated heat exchanger which requires cleaning to maintain its heat exchange efficiency. Accordingly, all suitable modifications and equivalents may be resorted to that fall within the scope of the invention and the appended claims.

What is claimed is:

1. A device for supporting an elongated heat exchanger having a plurality of spaced baffle plates supporting a plurality of perpendicular tubes, after the heat exchanger is removed from a vertical housing, and for cleaning the heat exchanger, comprising:

(a) elongated, movable means for supporting the heat exchanger, including two parallel main side members, a top member, a bottom member, a first plurality of clamps between the top and bottom members capable of moving up and down on the main members, one end of each of said first plurality of clamps being pivotally connected to a main side member to facilitate loading and removal of the heat exchanger relative to the device, and a second plurality of clamps capable of moving up and down on the main members between the top and bottom members, wherein each clamp abuts a baffle plate of the heat exchanger; and (b) vat means for horizontally receiving the heat exchanger and supporting means, in which the heat exchanger can be cleaned.

2. A device, for supporting an elongated heat exchanger after the heat exchanger is removed from a vertical housing, and for cleaning the heat exchanger, comprising:

(a) elongated, movable means for supporting the heat exchanger; and (b) vat means for horizontally receiving the heat exchanger and supporting means, in which the heat exchanger can be cleaned, wherein the supporting mean includes two parallel main side members, a top member, a bottom member, a first plurality of clamps capable of moving up and down on the main members, and a second plurality of clamps capable of moving up and down on the main members, wherein said clamps abut the heat exchanger and wherein each of the first and second plurality of clamps includes a half ring;

a bracket at each end of the half ring for receiving the main members; and means for connecting the brackets to the main members.

3. The device as recited in claim 2, further comprising:

means for pivoting one end of each of the second plurality of clamps relative to one of the main members; and means for temporarily latching the other end of each of the second plurality of clamps to the other of the main members.

4. The device as recited in claim 3, wherein the pivoting means comprises:

a hinge extension formed on the half ring, a hinge tab formed on the bracket, and a pin/spring clip combination extending through corresponding openings formed in the hinge extension and hinge tab.

5. The device as recited in claim 3, wherein the latch means comprises:

a clamp tab formed on a bracket and having an opening formed therein for receiving a pin which extends through one end of a clamp bolt to allow the clamp bolt to pivot, the clamp bolt terminating at an opposite free end in a pin, the half ring including a ring clamp extension which receives the pin.

6. The device as recited in claim 2, wherein the vat means includes V-supports for receiving the supporting means.

7. The device is recited in claim 6, wherein one of the V-supports includes means for pivotably receiving one end of the heat exchanger.

8. The device as recited in claim 2, further comprising means for turning the tube bundle in the vat means.

9. The device as recite in claim 3, wherein the heat exchanger is a turbine generator oil cooler tube bundle.

* * * * *